United States Patent [19]

Nilsen

[11] 3,964,228

[45] June 22, 1976

[54] WALL ELEMENT

[75] Inventor: Walter Nilsen, Lier, Norway

[73] Assignee: Den Norske Gipsplatefabrikk A/S, Drammen, Norway

[22] Filed: Nov. 22, 1971

[21] Appl. No.: 200,908

[30] Foreign Application Priority Data

Nov. 24, 1970 Norway ..... 4513/70

[52] U.S. Cl. ..... 52/620

[51] Int. Cl.[2] ..... E04B 2/28

[58] Field of Search ..... 52/615, 309, 618, 620

[56] References Cited

UNITED STATES PATENTS

| | | | |
|---|---|---|---|
| 2,621,378 | 12/1952 | Wilson | 52/615 |
| 3,071,853 | 1/1963 | Price | 52/615 |
| 3,225,505 | 12/1965 | Lytz | 52/615 |
| 3,305,986 | 2/1967 | Mathews | 52/615 |
| 3,462,897 | 8/1969 | Weinrott | 52/615 |

FOREIGN PATENTS OR APPLICATIONS

| | | | |
|---|---|---|---|
| 493,777 | 6/1953 | Canada | 52/615 |
| 751,620 | 6/1933 | France | 52/615 |
| 553,015 | 5/1943 | United Kingdom | 52/615 |

*Primary Examiner*—Ernest R. Purser
*Assistant Examiner*—Carl D. Friedman
*Attorney, Agent, or Firm*—Nolte and Nolte

[57] ABSTRACT

The present invention relates to a wall-element comprising a porous central portion, e.g. of synthetic products and stiff outer layers, e.g. of plaster.

4 Claims, 1 Drawing Figure

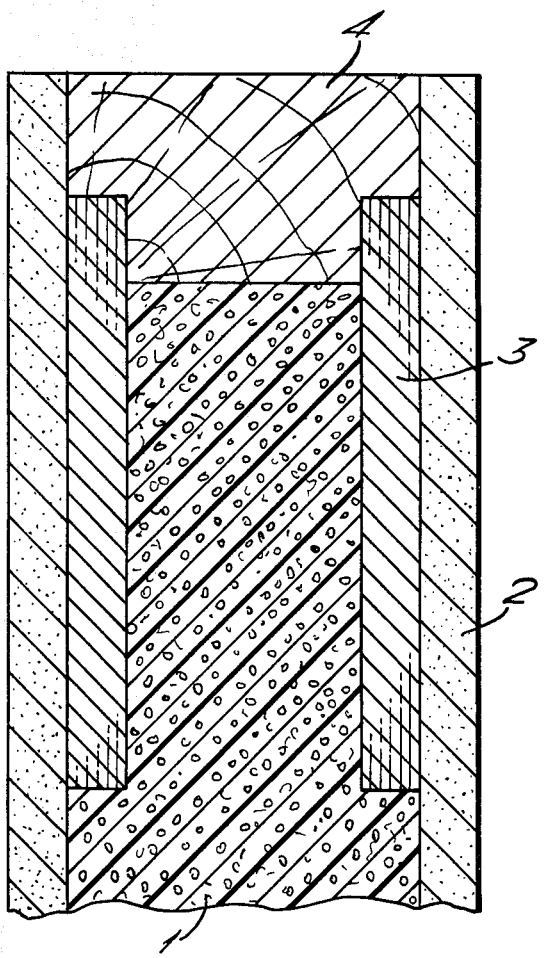
4
3
2
1

WALL ELEMENT

SUMMARY

The object of the invention is to provide an element of the kind which has the ability to absorb heavy loads, even at cut-outs of e.g. large window openings in the element. This is, according to the invention, achieved by a laminated beam being embedded or moulded into the upper edge of the wall-element, the beam thus acting as load absorbing means, said beam consisting of a wooden beam with a U-shaped cross-section, whose mid section forms the contact surface of the wall-element, and whose cavity is filled with the porous product, e.g. expanded plastic.

According to a further characteristic of the invention, the branch part of the U-shaped beam consists of plywood-strips, while the mid section is made up of one or more wood-lathes.

The lathe may further, according to an additional characteristic of the invention, be provided with notches for admission of the plywood-strips.

A wall-element according to the invention is thus provided which is capable of absorbing very heavy loads and which is thus suitable, especially for use in the erection of houses, according to U.S. Pat. application Ser. No. 145.459. Such a wall-element permits e.g. cut-out of windows or other openings of at least 2.5 m (8.2 ft.) in width.

The invention will be further described below by means of a construction example with reference to the drawing showing a cross-section of the upper edge part of a wall-element, according to the invention.

DETAILED DESCRIPTION OF THE INVENTION

1 denotes a central portion of a foam product, e.g. polyuretan. 2 denotes the stiff outer layers of the wall-element. The laminated beam is formed by means of plywood-boards 3, which e.g. may be glued firmly to the plaster-boards 2, the upper part of the central portion of the foam product and an edge lathe 4 which forms the upper contact surface. The edge lathe is provided with notches for admission of the one end-edges of the plywood-strips. The edge lathe and the plywood-strips may be connected together by means of glueing, stapling or nailing.

Such an element may be manufactured on a continuous production line, and thereafter cut into suitable lengths. One may then fix the adjoining plywood-strips onto the one plaster-board, as well as edge lathe 4, whereafter the foam product is applied and trimmed for the right thickness. Finally the upper plaster-board with the adjoining plywood-strips is put in position.

I claim:

1. A wall element having an upper edge and comprising first and second parallel spaced apart stiff outer layers extending to said upper edge, a U-shaped wall element load absorbing means extending between said layers at said upper edge and being affixed thereto, said layers and load absorbing means defining a cavity, and a porous material filling said cavity, said load absorbing means comprising a wooden beam having sides affixed to said layers and a top edge extending to the upper edge of said wall element, and a separate plywood strip extending from the bottom of said beam on each side thereof and affixed to the respective adjacent layer, the bottoms of the side of said beam being notched to receive said plywood strips, whereby said load absorbing means forms the upper contact surface of said wall element.

2. The wall element of claim 1 wherein said outer layers are plaster board.

3. The wall element of claim 1 wherein said beam is comprised of at least one wood lath.

4. The wall element of claim 1 wherein said porous material is a foam product.

* * * * *